United States Patent [19]

Erickson

[11] 4,363,178

[45] Dec. 14, 1982

[54] TRENCHER TOOTH QUICK ATTACHMENT

[75] Inventor: Terry D. Erickson, Wichita, Kans.

[73] Assignee: J. I. Case Company, Racine, Wis.

[21] Appl. No.: 272,812

[22] Filed: Jun. 11, 1981

[51] Int. Cl.[3] ..... E02F 3/14

[52] U.S. Cl. ..... 37/191 A; 83/831; 175/413; 299/93; 403/362

[58] Field of Search ..... 37/191 A, 192 A, 142 R, 37/141 R, 141 T, 86, 83; 83/831-835; 175/413; 299/93; 403/362

[56] References Cited

U.S. PATENT DOCUMENTS

| | | | |
|---|---|---|---|
| 1,918,169 | 7/1933 | Arndt | 37/142 R |
| 2,160,964 | 6/1939 | Godfrey | 37/142 R |
| 2,168,794 | 8/1939 | Fulke | 37/142 R X |
| 2,519,076 | 8/1950 | Schmidt | 37/191 A |
| 3,022,588 | 2/1962 | Brown | 37/191 A |
| 3,362,754 | 1/1968 | Morrow | 299/93 X |
| 3,846,922 | 11/1974 | Horton | 37/191 A X |
| 4,068,897 | 1/1978 | Amoroso | 175/413 X |

*Primary Examiner*—Paul T. Sewell
*Assistant Examiner*—Moshe I. Cohen
*Attorney, Agent, or Firm*—Cullen, Sloman, Cantor, Grauer, Scott & Rutherford

[57] ABSTRACT

A support assembly for trencher teeth or other tools including a mounting bracket which is retained on a bracket support by only one retaining pin thereby permitting quick and convenient installation on or detachment from a trencher digging chain. The mounting bracket is constructed for holding a pair of reversible trencher teeth made in accordance with the present invention, each tooth including plural cutting edges. The operator mounts a trencher tooth to one side of the mounting bracket until its forward cutting edge becomes dulled or damaged, and then, reverses the tooth to the opposite side of the bracket for further use. One end of the mounting bracket is formed with a downwardly depending hook-like projection which engages and locks against an end of the bracket support. The opposite end of the mounting bracket abuts against an upstanding vertical projection on the bracket support and is held thereto by a single retaining pin passing through the upstanding projection and into the bracket support. The trencher teeth are held within the mounting bracket by tooth attaching pins which are retained in transverse openings through the opposed ends of the mounting bracket. The longitudinal axes of the retaining pins are substantially perpendicular to and lockingly engage the tooth mounting portions which extend into the opposed sides of the mounting bracket. Thus, the present invention reduces the number of mounting parts required and material cost for trencher tooth attachments and provides an assembly that is convenient and quick to operate.

6 Claims, 6 Drawing Figures

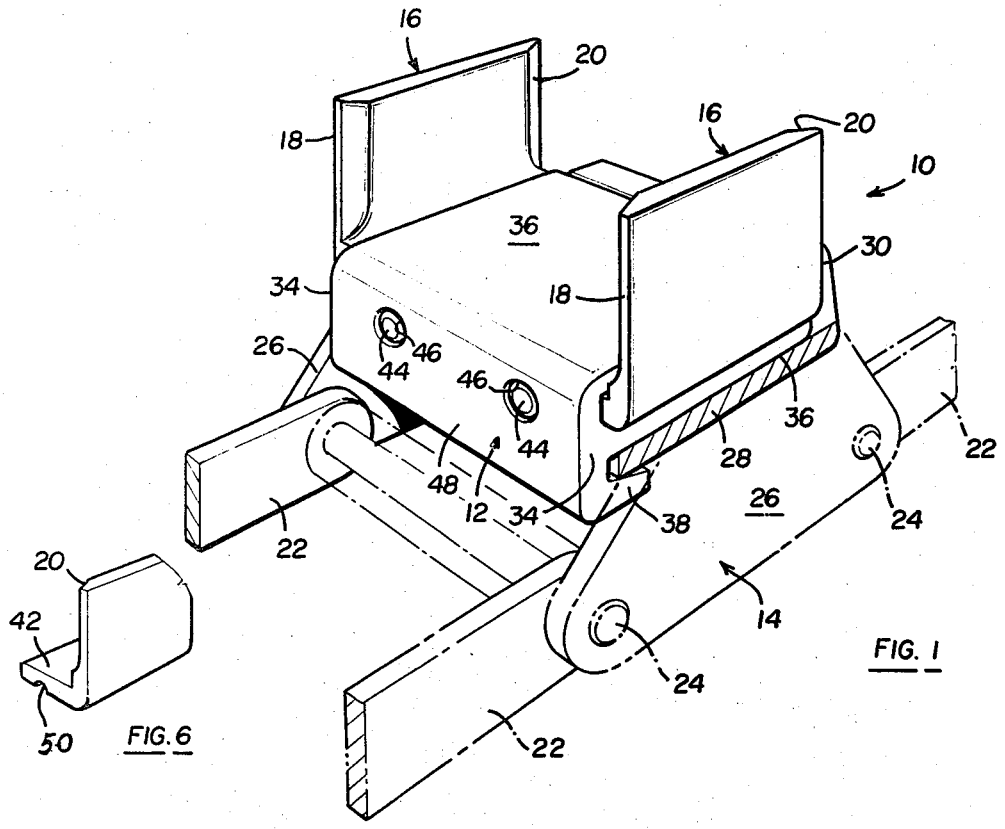
FIG. 1
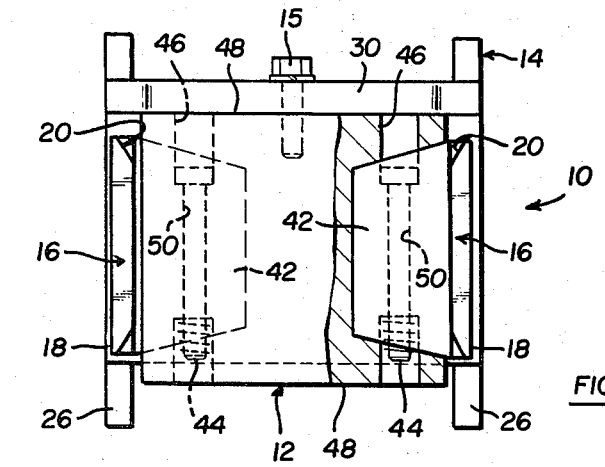
FIG. 6
FIG. 2
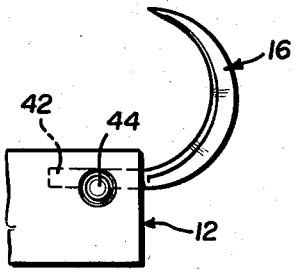
FIG. 5
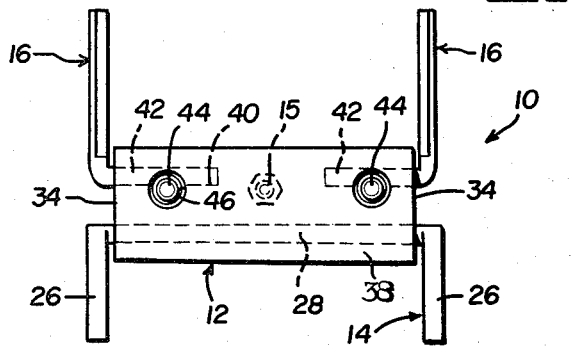
FIG. 3
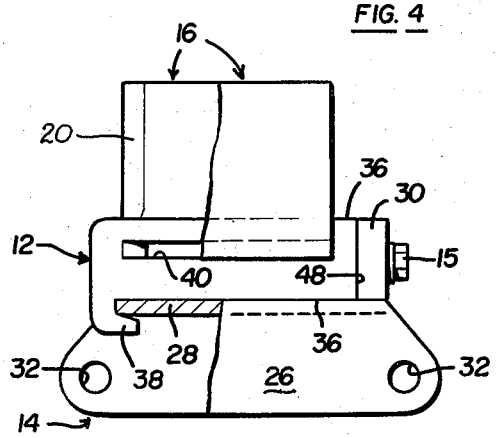
FIG. 4

TRENCHER TOOTH QUICK ATTACHMENT

BACKGROUND OF THE INVENTION

The present invention relates to an improved support assembly for trencher or digging teeth and more particularly to a detachable trencher tooth mounting bracket which is simple and inexpensive to manufacture, convenient and quick to operate, and dependable in operation.

It is conventional to provide a trenching machine including a boom which serves as a guide for a continuous digging chain that carries trenching teeth at spaced intervals. In accordance with known constructions, the digging teeth may be replaceable and retained in holders which are connected to the digging chain.

A problem with known attachment mechanisms for trencher or digging teeth is that several pieces of mounting hardware are required to attach each tooth which results in the attachment mechanism being expensive and the installation and removal procedure for the teeth being time-consuming. Another disadvantage of prior constructions is that the trencher or digging teeth can only be mounted to the tooth holder in one position. After the cutting edge of the tooth becomes dulled or damaged, the tooth is replaced and either discarded or refinished, thereby resulting in substantial operating cost.

Accordingly, it is an object of the present invention to provide a support assembly for trencher or digging teeth which substantially reduces the number of mounting parts required and is inexpensive to manufacture. It is another object of the present invention to provide a detachable trenching tooth mounting assembly which is simple in construction, convenient and quick to operate, and dependable in operation. A further object of the present invention is to provide a mounting assembly which utilizes reversible digging teeth of various forms and sizes and is adaptable for mounting other tools.

SUMMARY OF THE INVENTION

The structure embodying the present invention includes a trencher or digging tooth mounting bracket which is secured to a bracket support by means of only one retaining pin. The mounting bracket is constructed to hold a pair of reversible digging teeth made in accordance with the present invention, each tooth including plural cutting edges. The present construction provides the operator with considerable flexibility in utilizing the digging teeth. The operator may mount a digging tooth to one side of the mounting bracket for use until its leading cutting edge becomes dulled or damaged, and then, reverse the tooth to the opposite side of the bracket for further use. Alternatively, the operator may mount both teeth to the mounting bracket and reverse them after their leading cutting edges become dulled or damaged, thereby permitting further use of the teeth.

The bracket support for the trencher tooth mounting bracket is secured to the opposed links that make up the continuous digging chain on the trenching boom. The support is substantially U-shaped in transverse cross-section having spaced apart vertical side walls or legs and a horizontal top wall extending between and connecting the side walls. An upturned vertical projection is formed at one end of the horizontal top wall for abutting engagement with one end of the trencher or digging tooth mounting bracket. The spaced apart side walls or legs of the support are formed with apertures for connecting the support to the links of the trenching boom digging chain.

The unique trencher tooth mounting bracket is substantially rectangular in transverse cross-section and includes flat parallel opposed sides and flat top and bottom surfaces. One end of the mounting bracket is formed with a downwardly depending hook-like projection which engages and locks against an end of the top wall of the bracket support. The opposite end of the mounting bracket abuts against the upturned vertical projection on the top wall of the bracket support and may be held thereto by a single retaining pin that passes through the upturned projection into the bracket support. Thus, the mounting bracket and attached trencher teeth are removable from the digging chain by simply removing the single retaining pin.

The substantially solid trencher tooth bracket includes openings into its opposite sides for holding the trencher or digging teeth. These openings are tapered toward their interior ends to provide a tight wedging fit against the mounting leg portions of the trencher teeth which extend into the mounting bracket. Trencher teeth are held within the mounting bracket by tooth attaching pins which are retained in transverse openings through the opposed ends of the mounting bracket.

The longitudinal axes of the attaching pin openings are perpendicular to the longitudinal axes of the openings in the bracket side walls to provide a spatial relationship permitting locking coaction between the trencher teeth and attaching pins. Each tooth mounting portion includes at least one semi-circular recess for complementary engagement with the outer periphery of the tooth attaching pins thereby fixing the teeth in place. With the unique construction of the mounting bracket, a trencher tooth may be quickly and conveniently removed from the bracket by driving out the corresponding tooth attaching pin.

Each of the trencher or digging teeth used with the present construction includes opposed cutting edges on the leading and trailing ends. When it becomes necessary to replace a tooth because of wear on the leading cutting edge, the operator removes the worn tooth and reverses it for mounting on the opposite side of the mounting bracket such that the worn cutting edge becomes the trailing edge and the previously unused trailing edge becomes the new cutting edge. In addition, the tooth mounting leg portion which extends horizontally into the mounting bracket may include several spaced apart semi-circular recesses which permit the trencher tooth to be mounted at selected outward or lateral positions relative to the side of the mounting bracket.

The mounting bracket may be made in various widths for various digging operations. It may be necessary for facilitating wide cuts that each successive mounting bracket on a digging chain be made increasingly wider. This is easily accomplished by extending the opposed side walls of the mounting bracket to the desired width.

Thus, the present invention reduces the mounting time and materials costs for trencher or digging tooth attachments. Installation or removal of the mounting bracket and attached digging teeth is accomplished simply and quickly by means of one retaining pin. The mounting bracket also permits the use of specifically designed reversible digging teeth of various shapes and forms which would not be usable with conventional tool holders. Further, the construction of the mounting bracket permits other tools to be conveniently mounted.

Other advantages and meritorious features of the support assembly for digging teeth of the presentinvention will be more fully understood from the following description of the invention, the appended claims, and the drawings, a brief description of which follows.

BRIEF DESCRIPTION OF DRAWINGS

FIG. 1 is a perspective view of the support assembly for digging teeth of the present invention and illustrating its attachment to a trenching boom digging chain.

FIG. 2 is a top plan view of the digging tooth support assembly with a portion cut away for easier viewing.

FIG. 3 is an end view of the digging tooth support assembly.

FIG. 4 is a side elevational view of the digging tooth support assembly with a portion cut away for easier viewing.

FIG. 5 is a fragmentary view illustrating one alternate form of digging tooth that may be utilized with the support assembly.

FIG. 6 is a fragmentary perspective view of a digging tooth.

DETAILED DESCRIPTION OF THE INVENTION

A preferred embodiment of the support assembly for trencher or digging teeth made in accordance with the teachings of the present invention is illustrated in FIGS. 1–6.

The support assembly 10 embodying the present invention includes a trencher or digging tooth mounting bracket 12 which is secured to a bracket support 14 by means of only one retaining pin 15. The mounting bracket 12 is constructed to hold and retain a pair of reversible trencher or digging teeth 16 made in accordance with the present invention. Each digging tooth 16 includes plural cutting edges 18 and 20 which provide the operator with considerable flexibility in utilizing the digging teeth 16. With the present construction, the operator may mount a digging tooth 16 to one side of the mounting bracket 12 for use until its leading cutting edge 18 becomes dulled or damaged, and then, reverse the tooth to the opposite side of the bracket for further use. Alternatively, the operator may mount both teeth 16 to the mounting bracket 12 and reverse them simultaneously after their leading cutting edges 18 become dulled or damaged, thereby permitting further use of the teeth 16.

The bracket support 14 for the trencher or digging tooth mounting bracket 12 is securd by pins 24 to the opposed links 22 that make up the continuous digging chain on the trenching boom. The support 14 is substantially U-shaped in transverse cross-section, having spaced apart vertical side walls or legs 26 and a horizontal top wall 28 extending between and connecting the side walls 26. An upturned vertical projection 30 is formed at one end of the horizontal top wall 28 for abutting engagement with one end of the trencher or digging tooth mounting bracket 12. The spaced apart side walls or legs 26 of the support 14 are formed with apertures 32 for connecting the support 14 to the links 22 of the trencher boom digging chain.

The unique trencher or digging tooth mounting bracket 12 is substantially rectangular in transverse cross-section and includes flat parallel opposed sides 34 and flat top and bottom surfaces 36. One end of the mounting bracket 12 is formed with a downwardly depending hook-like projection 38 which engages and locks against an end of the top wall 28 of the bracket support 14. The opposite end of the mounting bracket 12 abuts against the upturned vertical projection 30 on the top wall 28 of the bracket support 14 and may be held thereto by a single retaining pin 15 that passes through the upturned projection 30 into the bracket support 12. Thus, the mounting bracket 12 and attached digging teeth 16 are removable from the bracket support 14 by simply removing the single retaining pin 16.

The substantially solid trencher or digging tooth mounting bracket 12 includes elongated openings 40 into its opposite sides 34 for holding the digging teeth 16. These openings are tapered at their interior ends as illustrated in FIG. 2 to provide a tight wedging fit against the mounting leg portions 42 of the digging teeth 16, which mounting leg portions extend into the mounting bracket 12. The trencher or digging teeth 16 are held within the mounting bracket 12 by tooth attaching pins 44 which are retained in transverse openings 46 through the opposed ends 48 of the mounting bracket 12.

The longitudinal axes of the attaching pin openings 46 are perpendicular to the longitudinal axes of the openings 40 into the bracket side walls 34 to provide a spatial relationship for locking coaction between the digging teeth 16 and attaching pins 44. Each tooth mounting portion 42 includes at least one semi-circular recess 50 in its underside for complementary engagement with the outer periphery of the tooth attaching pins 44 thereby fixing the teeth 16 in place. With the unique construction of the mounting bracket 12, a trenching or digging tooth 16 may be quickly and conveniently removed from the bracket 12 by driving out the corresponding tooth attaching pin 44.

Each of the digging teeth 16 used with the present construction include opposed cutting edges 18 and 20 on their leading and trailing ends. When it becomes necessary to replace a tooth because of wear on the leading cutting edge 18, the operator removes the worn tooth and reverses it for mounting on the opposite side of the mounting bracket 12 such that the worn cutting edge 18 becomes the trailing edge and the previously unused trailing edge 20 becomes the new cutting edge. In addition, the tooth mounting leg portion 42 which extends horizontally into the mounting bracket 12 may include several spaced apart semi-circular recesses 50 which permit the digging tooth 16 to be mounted at selected outward or lateral positions relative to the side 34 of the mounting bracket 12.

Thus, the present invention reduces the mounting time and material costs for digging tooth attachments. Installation or removal of the mounting bracket 12 and attached digging teeth 16 is accomplished simply and quickly by means of the one retaining pin 15. The mounting bracket 12 permits the use of specifically designed reversible digging teeth 16 of various shapes and forms as illustrated in FIGS. 1 and 5 which would not be usable with conventional tooth holders. Further, the construction of the mounting bracket 12 permits other tools to be mounted to it conveniently and quickly.

It will be apparent to those skilled in the art that the foregoing disclosure is exemplary in nature rather than limiting, the invention being limited only by the appended claims.

I claim:

1. A support assembly for digging teeth comprising:

a bracket support having a top wall and an up-turned vertical projection formed at one end;

a digging tooth mounting bracket having a body portion, opposed side walls, opposed end walls, and top and bottom surfaces, said mounting bracket being secured to said top wall of said bracket support, one end of said mounting bracket including a downwardly depending hook-like projection which engages and locks against an end of said bracket support top wall and the opposite end of said mounting bracket abutting against said up-turned vertical projection on said bracket support, and fastening means for securing said opposite end of said mounting bracket against said up-turned vertical projection, and said opposed side walls of said mounting bracket including elongated openings into said body portion;

a digging tooth being secured to said mounting bracket, said digging tooth including leading and trailing cutting edges and said digging tooth including a mounting leg portion which extends into one of said elongated openings in one side of said body portion, retaining means mounted between said opposed end walls of said mounting bracket and lockingly engaging said mounting leg portion to fix said digging tooth in place on said mounting bracket; and said digging tooth being removable from said one side of said mounting bracket for remounting in the other side of said mounting bracket such that said leading and trailing cutting edges are reversed when said digging tooth is mounted to said other side of said mounting bracket.

2. The support assembly as defined in claim 1 wherein said fastening means comprises a single mounting pin that passes through said upstanding projection on said bracket support and into said mounting bracket body portion.

3. The support assembly as defined in claim 1 wherein each of said elongated openings in the side walls of said mounting bracket being tapered towards an interior end within said body portion to provide a tight wedging fit against the mounting leg portion of said digging tooth.

4. The support assembly as defined in claim 1 wherein said bracket support being substantially U-shaped in transverse cross-section and having spaced apart vertical side walls, said bracket support top wall extending between and connecting said side walls, and said side walls including apertures whereby said bracket support is mountable on a digging chain.

5. The support assembly as defined in claim 1 wherein said retaining means includes at least one fastening pin that is secured within a corresponding fastening pin opening that passes through said opposed end walls of said mounting bracket, and the longitudinal axis of said fastening pin being substantially perpendicular to the longitudinal axis of said mounting leg portion.

6. The support assembly as defined in claim 3 wherein said mounting leg portion includes at least one recess for locking engagement with the periphery of said fastening pin.

* * * * *